US005142846A

United States Patent [19]

Alameda

[11] Patent Number: 5,142,846

[45] Date of Patent: Sep. 1, 1992

[54] APPARATUS AND METHOD FOR BAGGING A PRODUCT

[75] Inventor: Daniel Alameda, Pacific Grove, Calif.

[73] Assignee: Gabilan Manufacturing, Inc., Salinas, Calif.

[21] Appl. No.: 697,608

[22] Filed: May 9, 1991

[51] Int. Cl.[5] ..... B65B 57/02

[52] U.S. Cl. ..... 53/506; 53/573; 141/94; 141/140; 141/317; 493/9

[58] Field of Search ..... 53/505, 506, 69, 67, 53/570, 573, 571; 493/9; 141/140, 141, 317, 94, 369, 114, 10

[56] References Cited

U.S. PATENT DOCUMENTS

| | | | |
|---|---|---|---|
| 1,738,511 | 12/1929 | Anderson et al. . | |
| 2,513,459 | 7/1950 | Dodge . | |
| 2,711,278 | 6/1955 | Gray | 226/57 |
| 2,916,863 | 12/1959 | Leighton et al. . | |
| 3,408,903 | 11/1968 | Lepisto et al. . | |
| 3,556,578 | 3/1971 | Thorne et al. | 53/573 X |
| 3,680,446 | 8/1972 | James et al. | 226/22 X |
| 3,750,721 | 8/1973 | Hudson | 141/317 X |
| 3,807,122 | 4/1974 | Kihnke et al. | 53/506 X |
| 3,864,894 | 2/1975 | Sheetz et al. | 53/506 |
| 3,919,829 | 11/1975 | Burford et al. . | |
| 3,922,834 | 12/1975 | Clayton . | |
| 4,019,546 | 4/1977 | Hastrup | 141/10 |
| 4,125,986 | 11/1978 | Sheetz . | |
| 4,177,621 | 12/1979 | Powell, Jr. | 53/506 X |
| 4,253,292 | 3/1981 | Lipes | 53/506 X |
| 4,291,517 | 9/1981 | Lipos | 53/468 |
| 4,334,399 | 6/1982 | Onishi | 53/38.5 X |
| 4,336,681 | 6/1982 | Onishi | 53/459 |
| 4,432,186 | 2/1984 | McGregor | 53/573 X |
| 4,446,677 | 5/1984 | Kokido | 53/577 |
| 4,526,214 | 7/1985 | McGregor | 141/59 |
| 4,541,228 | 9/1985 | Petersen | 53/572 |
| 4,590,747 | 5/1986 | Schjeldahl . | |
| 4,593,516 | 6/1986 | Alameda et al. | 53/583 X |
| 4,614,213 | 9/1986 | Englin | 141/59 |

*Primary Examiner*—James F. Coan

*Attorney, Agent, or Firm*—Flehr, Hohbach, Test, Albritton & Herbert

[57] ABSTRACT

A bag detection apparatus (50) for sensing the position and seam integrity of a deformable bag (24) and bag transfer apparatus (53) for gripping and maintaining positive control of the edges (25) of the bag (24) during transfer from a bag filling station to a bag closure station. The bag positioning and seam integrity detecting apparatus (50) includes pneumatic conduits (60–67) mounted on the bag distending assembly (23) of a bag filling apparatus (20) and coupled to pressure switches (68). A controller (101), monitoring increases in pressure at each pressure switch (68), determines the position and condition of the mounted bag (24). The transfer apparatus (52) includes a pair of elongated arms (80) having hook-shaped gripping fingers (82) formed to engage and cooperate with clamping members (83) to grip the bag proximate the upper edge (25). A bag detection method also is provided.

9 Claims, 7 Drawing Sheets

APPARATUS AND METHOD FOR BAGGING A PRODUCT

TECHNICAL FIELD

The present invention relates, in general, to the packaging of products in flexible bags or containers and, more particularly, relates to an improved method and apparatus for bagging a product in a deformable bag and sealing it therein.

BACKGROUND OF THE INVENTION

The distribution of perishable items, such as produce, as well as non-perishable products in thin, usually transparent, plastic bags have become widespread over the years. Plastic deformable bags have considerable strength and, further, have storage capabilities which enhance product quality and extend useful life. Mass production of these bags through automated machines have made them particularly desirable, feasible and cost effective. Typically, these assemblies pull a length of sheet plastic off a roll and fold the plastic back substantially over itself. The machine then cuts the sheet and heat seals each of the two sides proximate the edges of the sheet, thus forming a plastic bag. U.S. Pat. No. 4,590,747 to Schjeldahl is typical of these devices in which there is a cam driven apparatus having a film spreading and clamping assembly formed for folding the film and sealing it to form an open ended bag. Subsequently, the bag is aligned and positioned to be received by an assembly suitable for filling the bag.

Filling assemblies have been developed which mechanically grip a bag in a distended position and insert a product therein. Typical of such prior art bagging apparatus is U.S. Pat. No. 4,590,747 to Schjeldahl or U.S. Pat. No. 3,864,894 to Sheetz et al. One reoccurring problem results when one or both sides of the bag is not effectively sealed or the seam is defective. Thus, when the bag is positioned and received on the filling assembly, seams which are defective separate spilling the product through the gap.

Another problem occurs when a plastic bag is placed askew on the filling assembly. Because these packaging machines often operate at high speeds, an improperly or only partially gripped bag can slip off the machine and the product being bagged spilled or discharged into the machine. When the product is dropped, the machine can become jammed, requiring the machine to be stopped while the product is cleared. The resulting time delays greatly reduce the efficiency of the bagging machine and accordingly increase the costs of packaging.

As a result of these problems, machinery soon developed which mechanically sensed whether the deformable bag was properly placed on the bagging machine or not. Typical of these devices is the apparatus disclosed in U.S. Pat. No. 3,864,894 to Sheetz et al. This patent is directed to a bag assembly having means for clamping a deformable bag in place, holding it open during filling and thereafter transferring the bag into an automatic bag tier. The bag is clamped using two pairs of complimentary finger assemblies that approach the bag laterally. A single mechanical switch detects whether a bag is missing or is not clamped between the finger assemblies before filling. Upon detection of a malfunction, the device automatically shuts down preventing further misoperation of the device.

The Sheetz, et al. device, however, uses a mechanical micro-switch as a sensor and can only determine if a bag is clamped or not. This sensor does not detect the relative position of the bag with respect to the filling assembly (i.e., whether it is askew or whether it is pulled up high enough). Moreover, the sensor in Sheetz, et al. does not test the integrity of the bag seams.

Still, other sensing mechanisms have been employed in the packaging industry. U.S. Pat. No. 3,680,446, to James et al. discloses an apparatus and method relating to forming sheet materials into bags. Web edge alignment of rolled sheets of film is detected by a pressure sensing device comprising a stream of fluid (usually air) directed at a pressure sensor with the sheet material therebetween. When the sheet material is aligned, the material intercepts the stream and only static pressure is measured However, when the sheets become misaligned, the fluid stream is uninterrupted and the sensors detect the dynamic pressure. Subsequently, guide rollers adjust accordingly to realign the sheets.

The approach in the James, et al. patent depends on an extremely complex arrangement of shiftable rollers, shafts, adjustment cylinders, sensors and circuitry. The circuitry and apparatus in this device, however, only determine whether the sheet is misaligned two dimensionally. That is, whether the edge of the sheet material is misaligned to the left or right of the sensor. Moreover, the James, et al. device does not include sensors or circuitry which test the integrity of the material or seams of the bag.

Once the filling assemblies have properly performed their respective filling tasks, it usually is desirable to transfer the filled bag to an assembly which performs the function of sealing the bag. These sealing devices generally grip the bag proximate the upper open end, form a throat or neck and apply a closure device to secure the bag in a sealed condition. Typical of these devices are U.S. Pat. Nos. 1,738,511, 2,711,278, 2,916,863, 3,919,829, 3,922,834, 4,291,517 and 4,593,516. Heat sealing, in which the opposing edges of an open end bag are melted together forming a hermetic seal, also has been employed, for example, the apparatus as shown in U.S. Pat. No. 4,446,667 to Kokido.

Many of the sealing assemblies set forth above require manual transfer between the bag handling and bag sealing devices. This transfer, however, can be the source of serious problems. Bags can be dropped or the product damaged during the transfer. Accordingly, it is desirable to easily transfer the bag relatively undisturbed from the filling assembly to the sealing assembly. For example, U.S. Pat. No. 4,125,986 to Sheetz, et al. discloses a bagging assembly including a pivotal transfer arm which swings the filled bag into the throat of an automatic bag tying assembly. A pair of mechanical clamps mounted to the transfer arm continually grip the bag open as the arm pivots into the throat of the tying assembly.

The Sheetz, et al. device, however, is not adaptable to filling assemblies which insert portions of the filling device into the bag, which can be required for bagging certain products, such as leafy produce. Additionally, the gripping and transfer arm mechanism in the Sheetz, et al. patent does not itself remove the bag from the filling assembly. The bag edge is continually gripped and the assembly never relinquishes hold of the bag during the filling and sealing cycle. Moreover, the pivotal nature of the transfer arm prevents transfer of the bag to the sealing assembly unless the filling assembly is completely removed from the bag.

Other transferring assemblies include movable carriage-type devices, such as U.S. Pat. No. 4,291,517 to Lipes. This reference provides a tab structure attached proximate the upper open end portion of the bag which is, in turn, slidably coupled to holding pins suitable for guiding the bag along tracks into engagement with a tying mechanism. This structure as a whole is nonadjustable and severe problems occur when a product interferes with the guiding tracts.

Finally, some bagging assemblies employ conveyor belt systems coupled between the filling assembly and the sealing assembly. U.S. Pat. No. 3,919,829 to Buford et al. and U.S. Pat. No. 2,513,459 to Dodge disclose such mechanisms. These devices, however, do not positively control the flexible open edges proximate the upper portion of the bag. Because of the flexible nature of the bag, if the open edges are not clear of the inserter, the edges will be smashed down and the product improperly inserted. Furthermore, when the bag is finally transferred to the sealing assembly, via the conveyor belt, bags having wrinkled or folded edges will not be properly positioned for engagement with the tying assembly resulting in bag sealing aberrations.

In commercial practice, the prior assemblies have been satisfactory for many applications. However, it is highly desirable to provide a bagging assembly and method capable of pneumatically detecting the position an condition of a deformable bag with respect to the bag filling assembly. Moreover, it is further desirable to provide an assembly and method capable of transferring the filled deformable bag from the filling assembly to the sealing assembly while maintaining positive control of the open end edges of the bag.

Accordingly, a primary object of the present invention is to provide a bag filling apparatus and method which permits the bagging of a product and sealing of the bag automatically without commercially unacceptable damage to the product.

It is another object of the present invention to provide an apparatus and method which increases packaging and production efficiency.

Still another object of the present invention is to provide a bag filling apparatus and method which will detect when a bag seam is not properly sealed.

Still a further object of the present invention is to provide an apparatus and method which will detect when a bag has been improperly gripped by the filling apparatus or is askew.

It is yet another object of the present invention to provide a bag filling apparatus and method which will warn the operator of the malfunction so that the bag can be either adjusted on the machine or removed and a new bag put in its place.

It is still another object of the present invention to provide a bag filling apparatus and method which will grippably remove the deformable bag from the filling apparatus while maintaining positive control of the bag edges and transfer it to the sealing apparatus.

It is a further object of the present invention to provide a bag filling apparatus and method which is durable, compact, easy to maintain, has a minimum number of components and is economical to manufacture.

The apparatus of the present invention has other objects and features of advantage which will become apparent from and are set forth in more detail in the description of the Best Mode of Carrying Out the Invention and the accompanying drawing.

DISCLOSURE OF INVENTION

The bag filling apparatus and method of the present invention includes a bag distending assembly formed for holding an open ended bag in a distending condition for receipt of a product. In the preferred form the bag distending assembly is provided by two hollow scoop o shell-like members which are movably mounted for displacement in a direction away from one another against the inside of the bag to distend or hold the bag open for filling. The product to be bagged is placed in the bag, most preferably by an inserter, which moves down inside the distending assembly and inserts the product into the bag.

In one aspect, the improvement in the bag filling apparatus and method designed in accordance with the present invention comprises, briefly, fluid bag detection means mounted on the bag distending assembly and including a conduit assembly with an array of discharge openings positioned on the distending assembly so that a bag properly mounted on the distending assembly will significantly increase the resistance to discharge of a fluid, preferably compressed air, from the openings. The sensing of an increase in resistance by a fluid pressure sensor enables detection of the presence of the bag in a proper position on the distending assembly for filling of the bag and sensing of the integrity, or lack thereof, of the bag seams.

In another aspect of the present invention, a bag transfer assembly is provided which cooperates with the bag distending assembly to enable gripping of the filled bag while it is distended, holding of the filled bag while the bag distending apparatus is collapsed, and transfer of the bag to a bag closure apparatus, such as a heat sealer.

The bag filling apparatus and method constructed in accordance with the present invention will be described in more detail below in conjunction with the accompanying drawing.

BRIEF DESCRIPTION OF THE DRAWING

Additional objects and features of the invention will be more readily apparent from the following detailed description and appended claims when taken in conjunction with the drawing, in which:

FIG. 8 is a front elevation view of the present invention, as viewed in FIG. 4, showing sensing of a seam has burst.

BEST MODE FOR CARRYING OUT THE INVENTION

Reference will now be made in detail to the preferred embodiments of the invention, examples of which are illustrated in the accompanying drawings. While the present invention has been described with reference to a few specific embodiments, the description is illustrative of the invention and is not to be construed as limiting the invention. Similarly, although primarily designed to determine the position and condition of deformable, heat-sealed, plastic bags, as well as providing a transfer assembly which maintains positive control of the upper edges of such bags, the present invention also is applicable to apparatus filling and transferring other types of deformable bags. Various modifications may occur to those skilled in the art without departing from the true spirit and scope of the invention as defined by the appended claims.

A. Bagging Sequence

Figure 1:
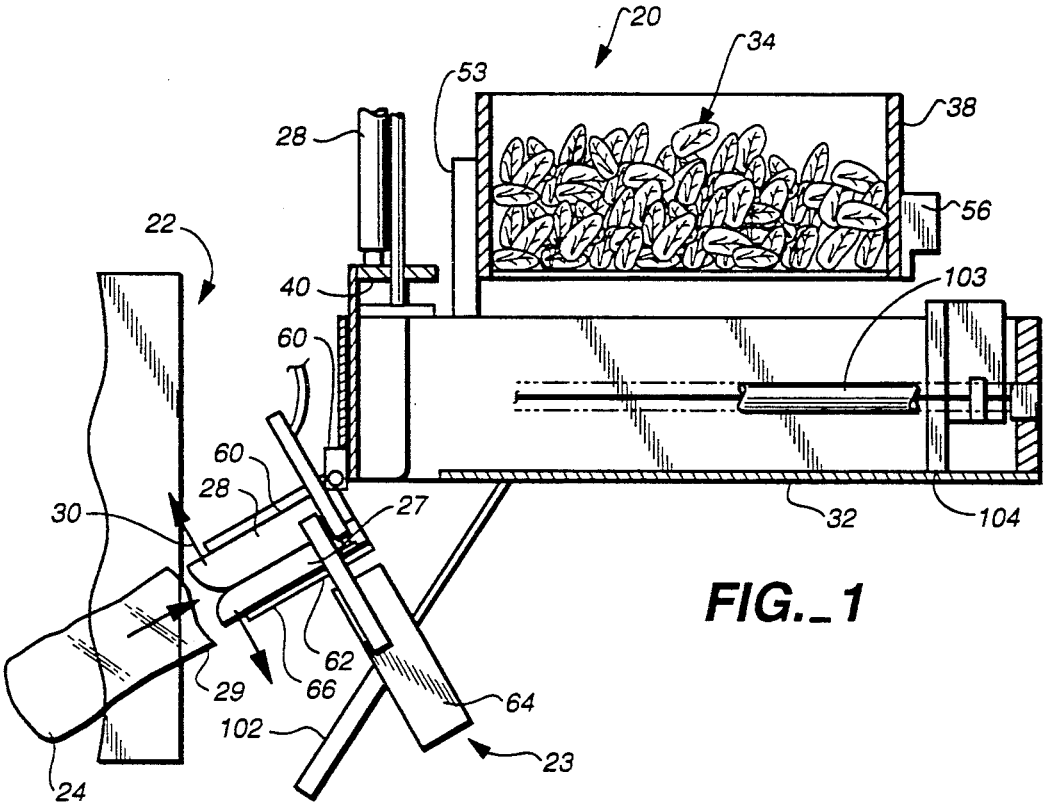
FIG. 1 is a schematic, side elevation view, in cross-section, of a produce bagging or filling assembly in a position to receive a bag and employing the sensing apparatus constructed in accordance with the present invention.
Figure 5:
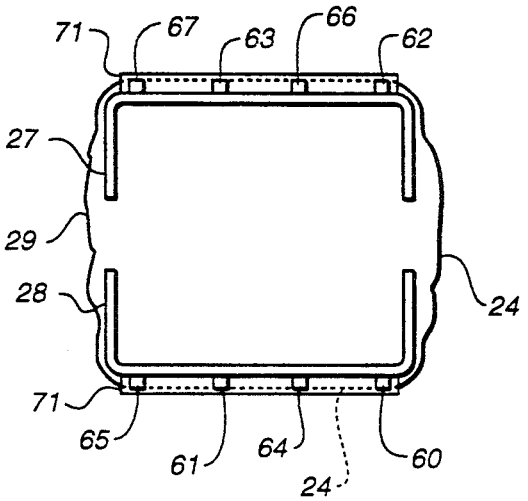
FIG. 5 is a top plan view corresponding to FIG. 4.
Figure 4:
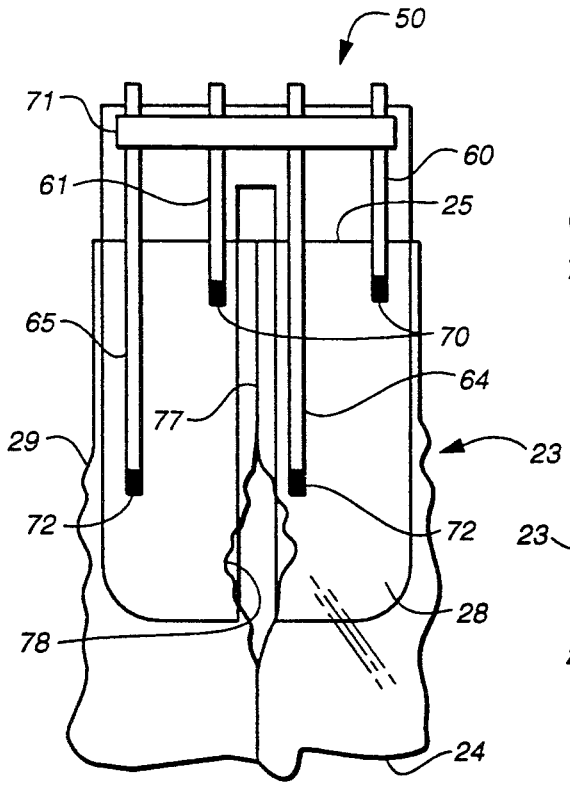
FIG. 4 is an enlarged, front elevation view of snout-like members of a bag filling assembly having a deformable bag thereon and employing the sensing assembly of the present invention.
Figure 6:
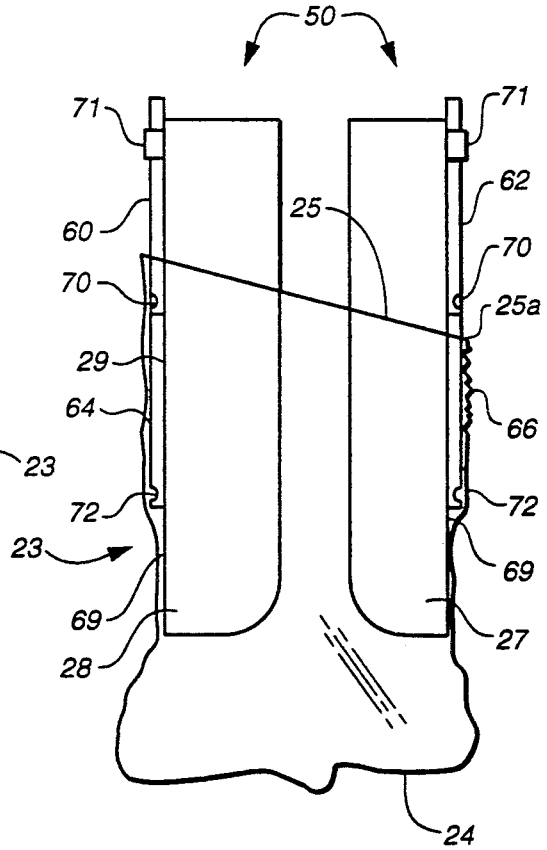
FIG. 6 is a side elevation view corresponding to FIG. 4 of the present invention, showing a bag mounted on the distending assembly in a skewed condition.

FIG. 1 illustrates a produce bagging or filling apparatus, generally designated 20, which may be used to describe the product bagging sequence and basic components of the apparatus of the present invention. Such a produce bagging apparatus is described in more detail in cop-pending patent application (Ser. No. 07/484,412) filed Feb. 2, 1990. Produce bagging apparatus 20 may be advantageously used with an automated bag forming apparatus, generally designated 22, and advantageously constructed in a manner such as is disclosed in U.S. Pat. No. 4,590,747 to Schjeldahl. Bag forming apparatus 22 constructs deformable, heat-sealed, plastic bag 24 and positions it for mounting onto bag filling apparatus 20. Filling apparatus 20, in the preferred form, includes a distending assembly 23 having a pair of movably mounted snout-like, C-shaped shell members 27 and 28, which are mounted for movement toward and away from each other. FIGS. 4, 5 and 6 illustrate in more detail the preferred form of bag distending assembly 23. C-shaped members 27 and 28 are mirror images of one another, and product 34, which is to be bagged, is placed inside bag 24 by passing the same down between members 27 and 28. The transverse dimension between members 27 and 28, when in a contracted condition, is less than the internal diameter or transverse dimension of bag 24. Thus, as shown in FIG. 1, members 27 and 28 are in a contracted position and prepared to receive an open end 25 of bag 24 from bag forming apparatus 22. As open end 25 of bag 24 is inserted over C-shaped members 27 and 28, distending assembly 23 causes movement of members 27 and 28 away from each other, as indicated by arrows 30, until the bag is frictionally retained by expanded snout assembly 23. Accordingly, as viewed in FIG. 5, inner wall 29 or bag 24 is engaged by snout members 27 and 28, which also extend a substantial distance inside bag 24, as may be seen in FIGS. 4 and 6.

Figure 7:
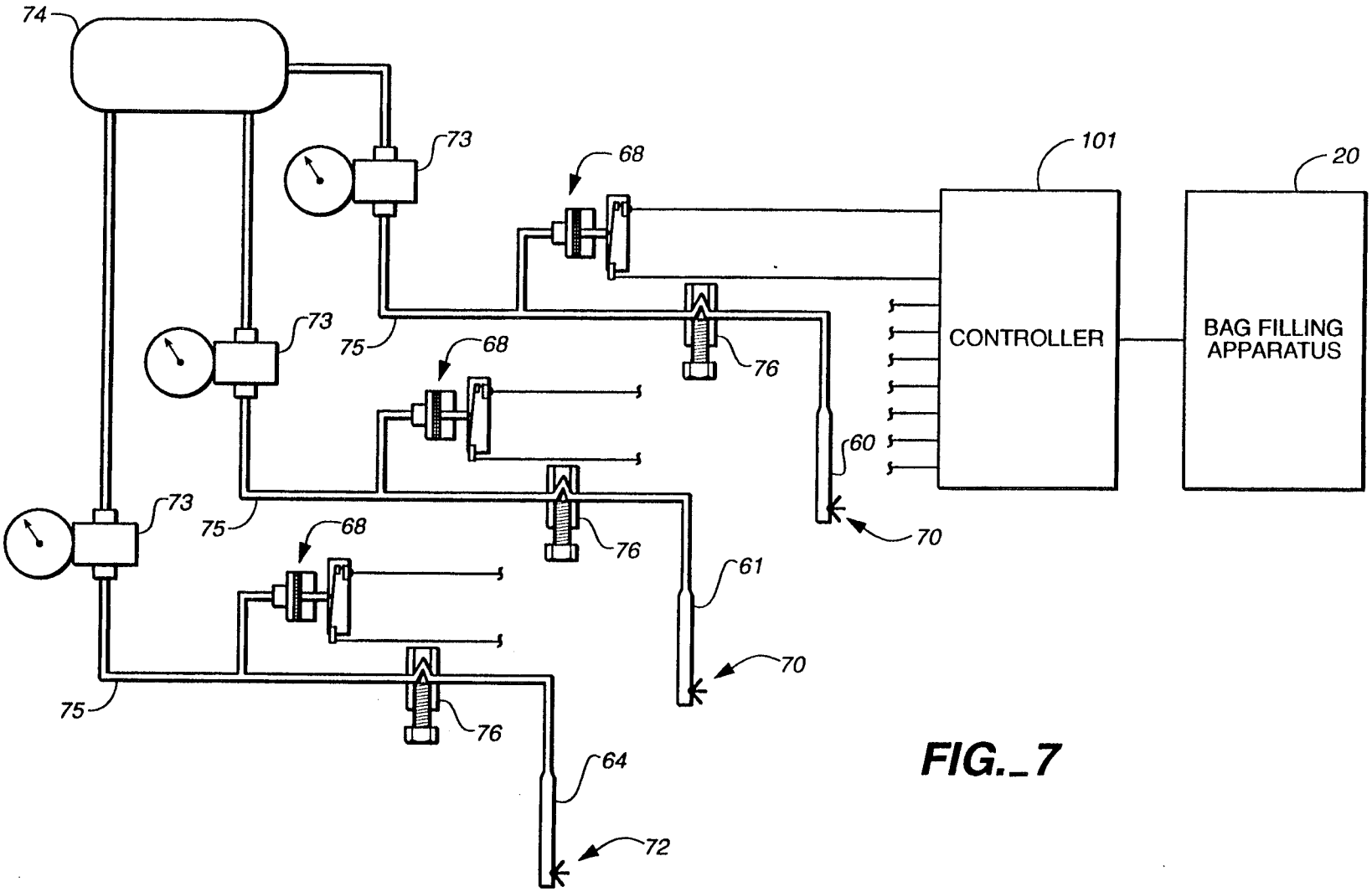
FIG. 7 is a schematic view of the bag sensor pneumatic circuitry constructed in accordance with the present invention.

In the preferred embodiment, a fluid bag detection means generally designated 50, is mounted on bag distending assembly 23, preferably at a plurality of positions around the periphery of snout-like members 27 and 28. FIGS. 4–6 illustrate fluid bag detection means 50 which includes conduit means preferably in the form of a plurality of conduits or tubes 60–67 having discharge openings 70 and 72 for the discharge of a fluid, preferably compressed air, therefrom. Fluid coupled to conduits 60-61 is pressure sensing means 68 (FIG. 7). As will be discussed in greater detail below, tubes 60-67 distribute a gas through openings 70 and 72 to positions on distending assembly 23 which are sufficiently close to bag 24 to result in a significant increase in the resistance to discharge of fluid from the tubes when the bag is properly positioned on the distending assembly that sensing means 68 can sense the positioning and integrity of the bag. Most preferably this is accomplished by orienting discharge openings 70 and 72 to face outwardly on the exterior of snout members 27 and 28 so that the inner surface of bag wall 29 is distended across openings 70 and 72. Pressure switches 68 detect the increase in pressure (i.e., resistance to fluid discharge resulting from positioning of walls 29 over openings 70 and 72. As the pressure reaches a predetermined figure, individual switches 68 close, indicating that the particular orifice is effectively covered by wall 29. It follows that when a particular orifice 68 is not covered effectively, the necessary resistance pressure for that tube will not exist.

Controller means 101 (FIG. 7) is coupled to each individual pressure switch 68 and is programmed to monitor the present state of each switch (i.e., whether opened or closed). Controller 101, therefore, can determine the position of bag 24 with respect to discharge openings 70 and 72 on snout members 27 and 28. In other words, depending on the configuration or combination of locations of openings 70 and 72 controller 101 may determine the position, straightness and, as will be explained below, integrity or condition of bag 24. For instance, if bag 24 is absent from the C-shaped members 27 and 28, or the same is held askew, wall 29 will not effectively seal all or some of orifices 70 and 72. Similarly, the integrity of seam 77 (FIG. 9) of bag 24 can be determined as distending means 23 displaces outwardly, stressing seam 77. If seam 77 ruptures, a discharge tube located proximate the rupture will not experience the appropriate increase in resistance or pressure resulting in the corresponding pressure switch 68 remaining open. Faulty bag structure or misplacement will be detected whereby controller 101 can stop filling of the bag and bag 24 may be manually or automatically replaced.

Figure 2:
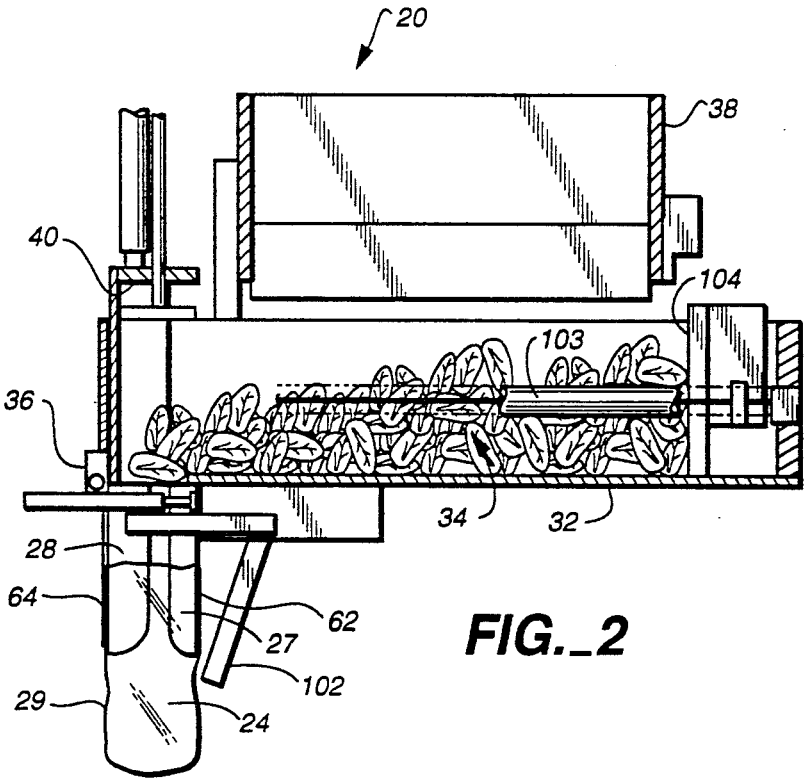
FIG. 2 is a side elevation view corresponding to FIG. 1 with the bag mounted over the filling assembly and over the sensing assembly of the present invention.
Figure 3:
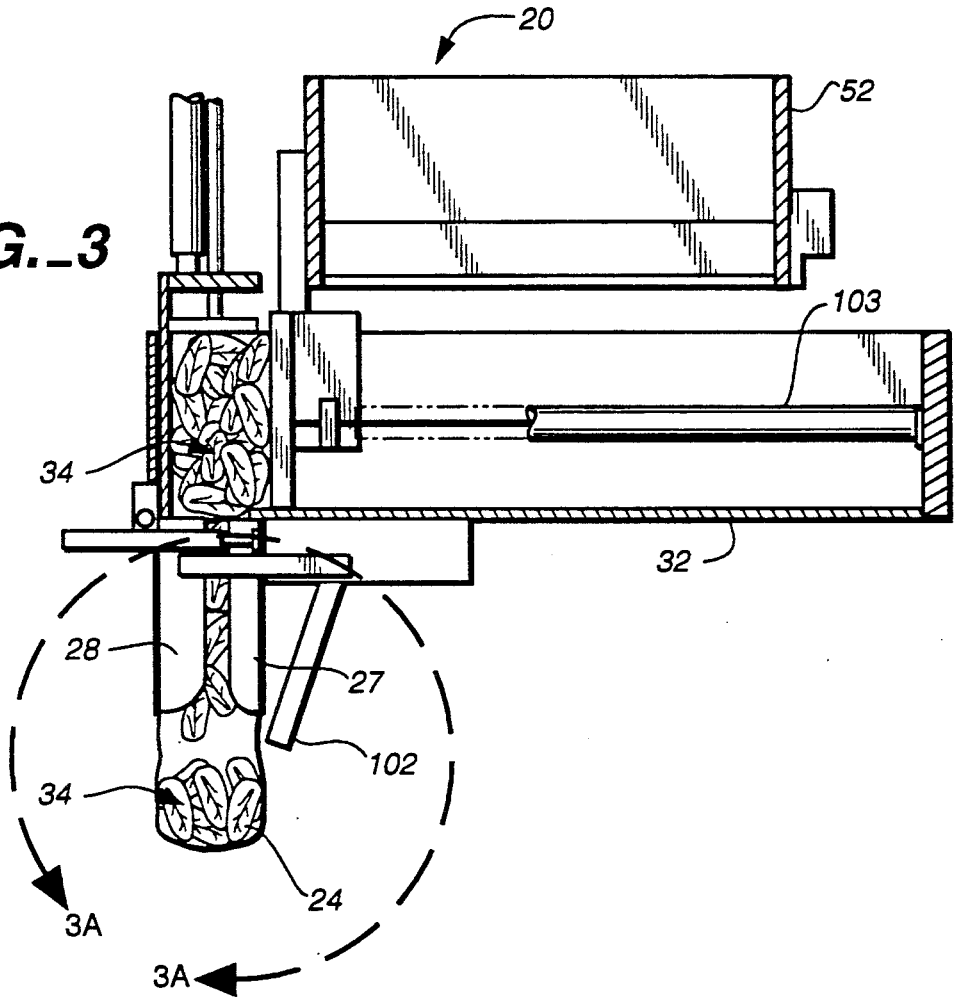
FIG. 3 is a side elevation view corresponding to FIG. 2 showing the product to be bagged transferred to a vertical channel aligned with the bag and an inserter sleeve.

Once the bag has been placed on distending assembly 23 and it has been determined that bag position and condition is suitable for filling, the next step of the bagging sequence may ensue. Bag distending assembly 23 is mounted for pivotal movement proximate the bottom corner of horizontal trough 32. Assembly 23 is pivoted about joint 36 by pneumatic actuator 102 to bag filling position as shown in FIG. 2. Product 34, here schematically illustrated as leafy produce, is transferred from weighing hopper 38 to horizontal trough 32. Pneumatic actuator 103 drives pusher blade 104 across trough 32 from the position in FIG. 2 to the position of FIG. 3. Some of produce 34 drops into bag 24 while the rest is inserted down into bag 24 by inserter assembly 40, in a manner described in detail in co-pending application Ser. No. 07/484,412.

After bag 24 has been properly filled, the next step is to remove bag 24 from filling assembly 20 and transfer the bag to a sealing or tying assembly (not shown). FIG. 3A shows bag 24 mounted to distending assembly 23 and a bag transfer assembly, generally designated 52, most preferably provided by a pair of mechanically movable elongated arms 80. Protruding from the distal ends of arms 80 are gripping assemblies which advantageously can include hook-shaped finger portions 82, and movably mounted, opposed clamping members 83. In order to permit gripping of the upper edge or open end 25 of bag 24, distending shell-like snout members 27 and 28 are preferably formed with longitudinally extending slots 90 which are dimensioned for receipt of hook-shaped fingers 82 and clamping members 83. Arms 80 are positioned proximate and above upper edge 25 of bag 24. As viewed in FIG. 3A and further illustrated by direction arrows 95, arms 80 are mounted by a mounting assembly (not shown) and are driven by actuators (also not shown) to move laterally so that fingers 82 are inserted into slots 90, as best may be seen in FIG. 8A. After proper alignment with the opposing edges 25 of bag 24, arms 80 move vertically downward in the direction indicated by arrows 96 until a sensor, such as photoelectric cell 84 (FIG. 8A) senses the presence of edge 25. At this point hook-shaped fingers 82 are positioned inside upper edge 25 of bag 24 and clamping members 83 are positioned below upper edge 25. A pneumatic actuator in arms 80 then moves members 83 toward fingers 82 to grip or clamp upper edge 25 of bag 24 at two opposed circumferential locations around the open upper end of the bag. This bag gripping operation takes place while the bag is still distended by displaceable snout members 27 and 28.

Figure 3B:
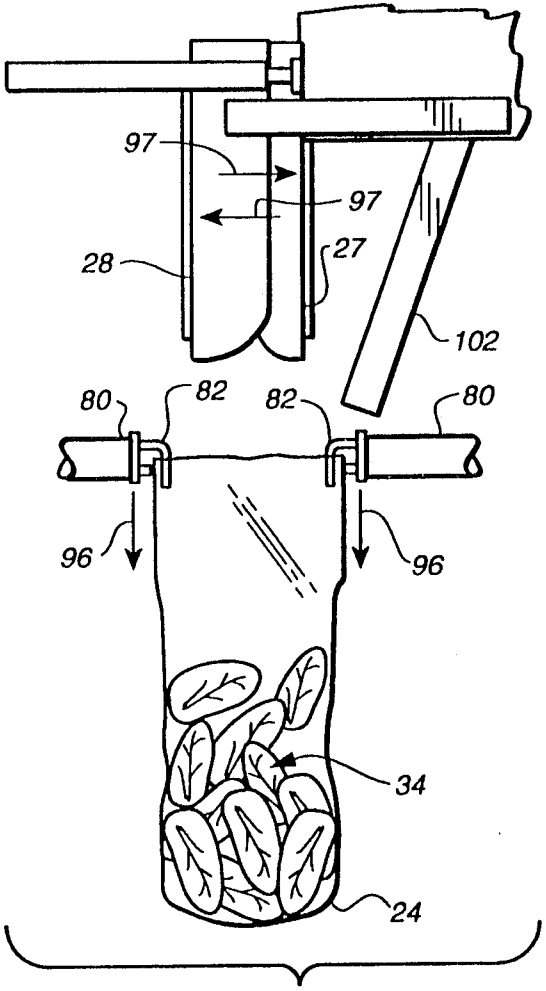
FIG. 3B is a fragmentary, side elevation view corresponding to FIG. 3A showing the transfer apparatus of the present invention after gripping of the bag and removal from the bag filling assembly.
Figure 3A:
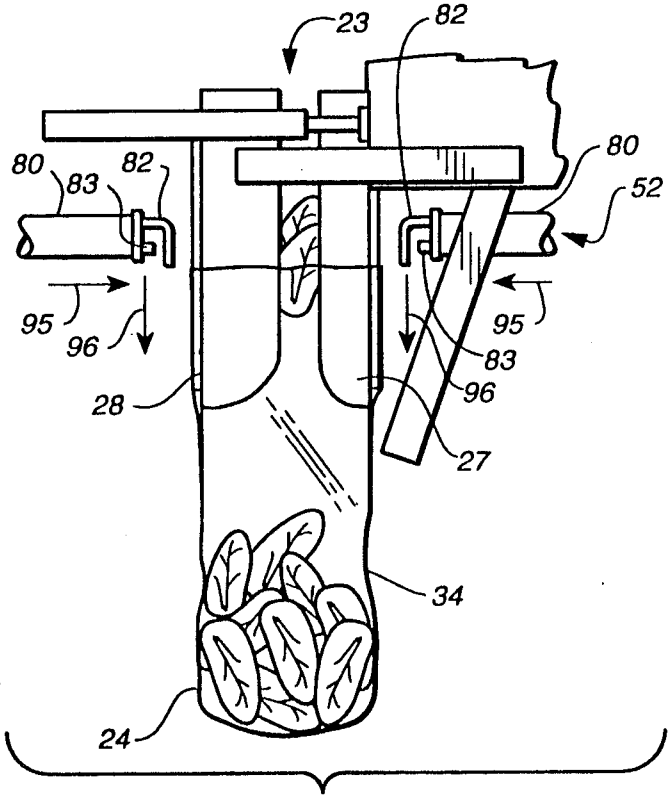
FIG. 3A is an enlarged, fragmentary, side elevation view corresponding to FIG. 3 and illustrating bag transfer apparatus constructed in accordance with the present invention and about to grip a produce filled bag.

Once the bag is gripped, snout members 27 and 28 are moved inward in the direction of arrows 97 in FIG. 3B, collapsing the snout assembly and releasing bag 24 from distending assembly. Simultaneously, arms 80 move vertically downward in the direction shown by arrows 96, removing bag 24 from filling apparatus 20. Lastly, although not illustrated in FIG. 3B, arms 80 transfer bag 24 to a tying or heat sealing apparatus. Thus, the initial positioning of bag 24 on distending assembly 23 is sensed by detection means 50, the distending assembly holds the bag in place during filling, and bag gripping assembly 52 grips the bag while being held by the bag distending assembly to provide very positive control over manipulation of the bag from mounting on the bag filling apparatus to sealing of the filled bag.

B. Fluid Bag Detection Assembly-Detail

FIGS. 4, 5 and 6 show a plastic, heat-sealed bag 24 mounted on C-shaped snout members 27 and 28. Expansion of members 27 and 28 slowly occurs until a predetermined resistance to displacement is reached when bag walls 29 are distended over the snout assembly and the bag is frictionally secured on the snout for filling.

Fluid bag detection means 50 is most preferably a pneumatic sensing system 50 in which a plurality of elongated pneumatic tubes 60-67 extend downwardly in a parallel fashion from the upper portion of snout members 27 and 28. In the preferred embodiment, as can be seen in FIGS. 4–6, two sets of four tubes 60, 61, 64, 65 and 62, 63, 66, 67 are positioned in spaced apart relation on exterior surface 69 of each C-shaped member 27 and 28. When distending assembly 23 displaces members 27 and 28 outwardly, wall 29 of bag 24 is brought into contact and engages all discharge tubes 60–67. The lengths of tubes 60–67 are selected to provide both bag position sensing and bag integrity sensing.

In order to enable sensing of the position of bag 24 on distending assembly 23, it is preferable to employ a first pair of laterally spaced apart conduits 60 and 61 on one side of snout assembly 23, namely, on shell-like snout member 28. As will be seen discharge openings on first pair of conduits 60 and 61 are positioned on about a common first horizontal or transversely extending plane. Mounted on opposed shell-like snout member 27 are a second pair of conduits 62 and 63 which have discharge openings 70 positioned on about the same horizontal plane as opening 70 on the first pair of conduits.

As best may be seen in FIG. 6, if bag 24 is placed on assembly 23 in a skewed position, for example, with one corner **25*a* below discharge opening 70 on fluid conduit 62, sensing means 68 will sense an increase in the discharge pressure for tubes 60, 61 and 63, but not for tube 62. Controller 101, will be able to compare the discharge pressure for four tubes, determine that bag 24 has not covered opening 70 on tube 62**, prevent filling of the bag, remove the bag (for example, by contracting the snout assembly) and position the bag distender to receive another bag.

As will be understood, the same process will take place if bag 24 is mounted short on the snout, that is, edge 25 is not skewed, but is below the plane of all openings 70. If detection assembly 50 detects that 2 or 3 consecutive bags are not properly positioned, rather than continuing the bag mounting cycle, the controller optionally can stop cycling and sound an operator alarm, permitting the operator to trouble shoot the bag placement problem.

Bag detection means 50 also acts to detect bag seam integrity or ability of the bag to hold product. Bag 24 preferably is formed by folding a continuous sheet or web of material upon itself, heat sealing the sides of the bag to form seams 77 and cutting the bag off the web. If the bag seams are not sound, even a properly placed bag will fail when the snout expands or product is placed in the bag.

First and second pairs of conduits 60-63 will detect seam failures proximate open end 25 of the bag. Thus, if seam 77 should fail to seal or pull apart proximate edge 25, the interior bag surface will not be held in sufficiently close contact to openings 70 to cause a pressure rise above the predetermined threshold indicating the presence of a bag over openings 70. This is true even though the lower end of the seal 77 may be sufficient to hold the bag on the distending snout assembly.

In order to sense seam failures a substantial distance from upper bag edge 25, bag detection assembly preferably includes a third pair of laterally spaced apart conduits 64 and 65 on shell 28 and a fourth pair of laterally spaced apart conduits 66 and 67 on opposite shell 27. Fluid conduits 64-67 each have discharge openings 72 positioned substantially on a second horizontal or transverse plane axially spaced from the plane of openings 70.

If a seam failure occurs proximate the bottom end of the bag, for example, at 78 in FIG. 4, bag 24 will blouse-out or move away from openings 72 and the resistance to gas discharge will not rise to a sufficient level to verify that seams 77 are sound and that the bag is capable of receiving product.

It is extremely important to sense both bag placement and bag integrity since going forward with the bag filling cycle when there is no bag present, the bag is improperly positioned on the distending assembly, or the bag is burst at the seams, will result in bag failure and discharge of the contents into the bag filling apparatus. This usually requires shut down of the equipment and costly clean up.

Referring now to FIG. 7, a schematic diagram of a pneumatic circuit suitable for use in bag detection apparatus 50 is shown. A source of fluid can be supplied from a pressurized tank, or more preferably, by a compressor (not shown) and reservoir. Regulation of air pressure in the pneumatic circuit is provided by air regulator 73 which regulates the air pressure in conduit 75 and accordingly the air pressure discharged through each individual opening or orifices 70 and 72. Typically, air regulator 73 adjusts supply pressure down to about 15–25 pounds per square inch, which is bled or discharged constantly out the small (about 0.030 inches diameter) discharge orifices 70 and 72. It will be understood that for some applications larger or smaller pressures may be employed, the size of the discharge openings may be varied to produce a range of discharge flow rates. It also will be understood that controller actuated valve means can be provided for intermittent, rather than constant discharge of gas. Thus, gas discharge could occur only during the time period after bag forming apparatus 22 places a bag on assembly 23 until sensor assembly 50 detects the presence and soundness of the bag.

Each discharge conduit 60–67 is coupled by a supply line 75 to regulator 73 and provided with an individual pressure contact switch 68 responsive to the respective pressure in that conduit. Sensitivity of switch 68 is easily controlled by needle valve 76, which can be adjusted to provide a steady state resistance at switches 68. Consequently, when bag 24 properly covers orifice 70, the increase in pressure in line 75 is seen or sensed back through valve 76 to pressure switch 68, causing the switch in that line to close and send a bag placement signal to controller 101. Controller 101, therefore, can determine the state of all pressure switches 68 and detect whether or not bag 24 is properly placed over the detection openings.

It will be appreciated that other configurations of fluid conduits and discharge openings may be used without departing from the novel nature of the present invention. A greater number of tubes having a variety of lengths may be employed, for example, if a more precise assessment of the position and condition of bag 24 is required.

The cross-section shape of tubes 60-67 may advantageously be rectangular, however, virtually any geometric shape could just as easily be used. Finally, as viewed in FIGS. 4–6, tubes 60–67 preferably include mounting means, such as a rectangular bracket 71, which hold the tubes in an array which can be easily mounted to snout member 27 and 28. Any method of rigid attachment of brackets 71 to members 27 and 28 may be employed.

Pneumatic bag detection means 50 of the present invention has been illustrated by a system in which a positive pressure is presented at openings 70 and 72. It will be understood within the scope of the present invention that a negative pressure, or vacuum detection system, also could be employed. If air is pulled or sucked in through opening 70 and 72, placement of the bag over the openings would increase the vacuum in line 75 and a sensor could be used to sense such an increase. A vacuum detection system would probably be intermittently operated so as not to resist removal of the bag from assembly 23. In the broadest form, therefore, detection means 50 senses a change in the resistance to the passage of a fluid in or out of the openings 70 and 72 to detect the presence or absence of bag 24 in the proper position and to detect its integrity.

The bag detection method of the present invention is capable of detecting the presence or absence of the bag and the bag or seam integrity. Thus, the present method includes the steps of passing a fluid, usually discharging a gas, out openings 70 and 72 positioned to be closed by the bag when the bag is properly retained on bag filling apparatus 20. Additionally, the present method includes the step of sensing the pressure in the fluid conduit, usually by sensing a pressure increase, to determine whether or not bag 24 is properly positioned and whether or not the seams are sealed. The sensing step can then be followed by a step of preventing or allowing actuation of the bag filling cycle depending upon whether the bag is properly positioned and in a sound condition.

C. Bag Transfer Assembly-Detail

Once bag 24 has been properly positioned and filled with product 34 by filling assembly 20, it must be removed from C-shaped snout members 27 and 28, and transferred from the bag filling station or apparatus to a bag closure station or bag sealing assembly. According to the present invention, there is provided a transfer apparatus 52 which positively controls the upper edges 25 of a deformable bag 24 during transfer. Referring now to FIG. 4, slot 90 begins proximate the upper portion of snout member 28 and runs longitudinally downward and substantially parallel to tubes 60, 61, 64 and 65. Similarly, although not shown, there is formed a matching slot running longitudinally down snout member 27. Slots 90 are formed for receipt of transfer apparatus 52.

Figure 8A:
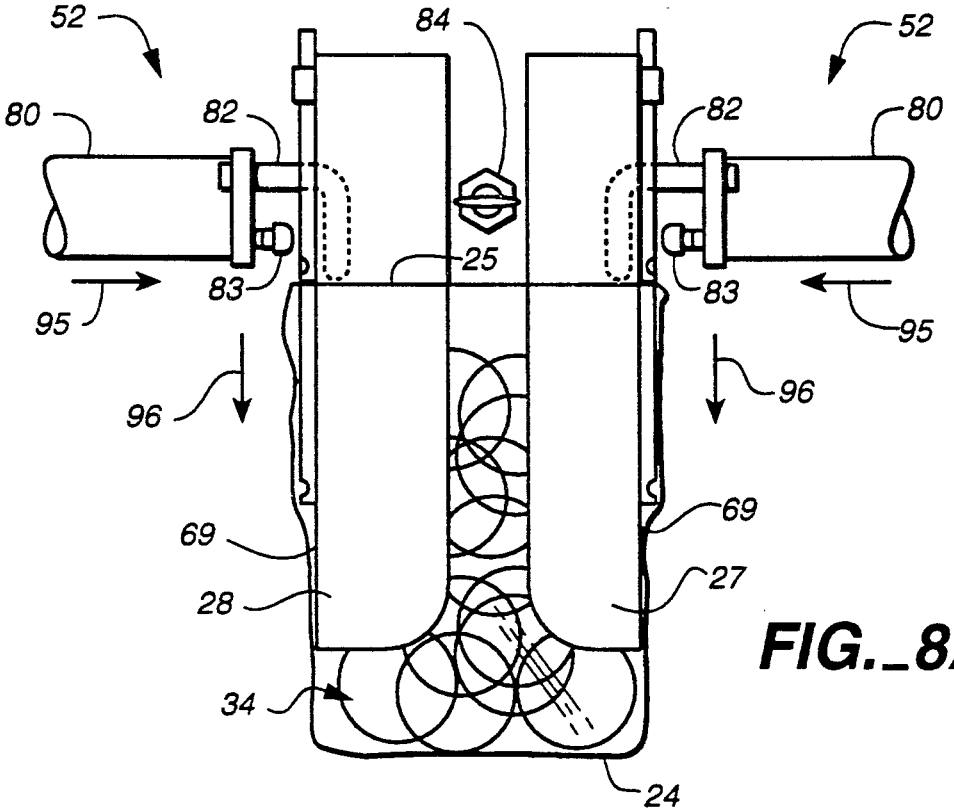
FIG. 8A through 8C shows a series of side elevational schematic views of the transferring apparatus at various stages of operation and designed in accordance with the present invention.

Turning to FIG. 8A, bag transfer assembly 52, according to the present invention, provides a pair of mirror-image bag gripping assemblies including longitudinal arms 80 situated along a common axis and positioned perpendicularly to intermediate planar surfaces 69 of the snout members. Located at the upper distal ends of arms 80 are hook-shaped finger portions 82 protruding downward and dimensioned for insertion into slots 90. Thus, slots 90 must extend above and beyond the nominal position of upper edge 25 of the bag on the distending assembly so as not to interfere with insertion of finger portions 82. Also mounted and protruding outwardly from the distal ends of arms 80 are movable clamping members 83. Clamping members 83 can be provided as pistons on pneumatic actuators which move outward from the distal ends of arms 80 in the direction represented by arrow 95. Furthermore, as can be viewed in FIG. 8B, clamps 83 are aligned such that the tip portions, when fully extended, ultimately abut against the downward portion of hook-shaped fingers 82.

After filling assembly 20 places product 34 into bag 24, elongated arms 80 are moved in the direction of arrows 95 to insert finger portions 82 into slots 90. It will be understood that the pneumatic or hydraulic mechanisms used to move arms 80 are common in the field and do not constitute a portion of the novelty of the present invention. Hook-shaped fingers 82 are vertically positioned just above upper bag edge 25. As such, finger portions 82 may be inserted into slots 90 without interfering with bag edge 25. Finger portion 82 and retracted clamping members 83 are positioned on either side of bag wall 29. Arms 80 are then displaced slowly in a vertically downward direction, as shown by arrows 96, to a position wherein the downward portion of hookshaped fingers 82 together with clamping members 83 are proximate and below bag edge 25.

In the preferred form a photoelectric eye 84 is coupled to a control means (not shown), and used to locate bag edge 25 for vertical positioning of arms 80 with respect to bag edge 25. This aspect of the invention, however, is preferred, although not absolutely required. Vertical displacement of arms 80 could be predetermined. Thus, if upper bag edge 25 of bag 24 is positioned higher than normal, because of the flexible nature of bag 24, upper edges 25 would just gather under the horizontal portion of fingers 82.

Figure 8B:
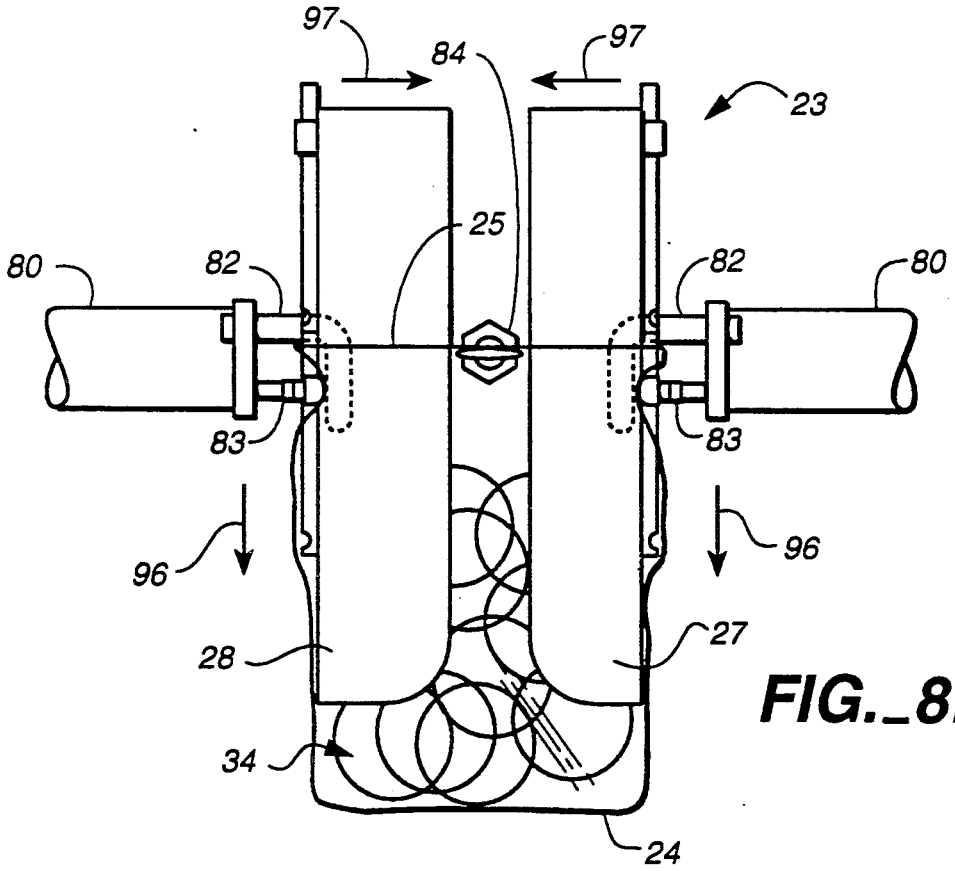

Once transfer apparatus 52 is correctly positioned, movable clamping members 83 extend outward from the distal ends of arms 80 until members 83 abut against the downward portion of fingers 82 to grip circumferentially spaced apart portions of bag edge 25 therebetween. FIG. 8B illustrates the bag as gripped by the transfer assembly while still held in place by bag distending assembly 23.

Figure 8C:
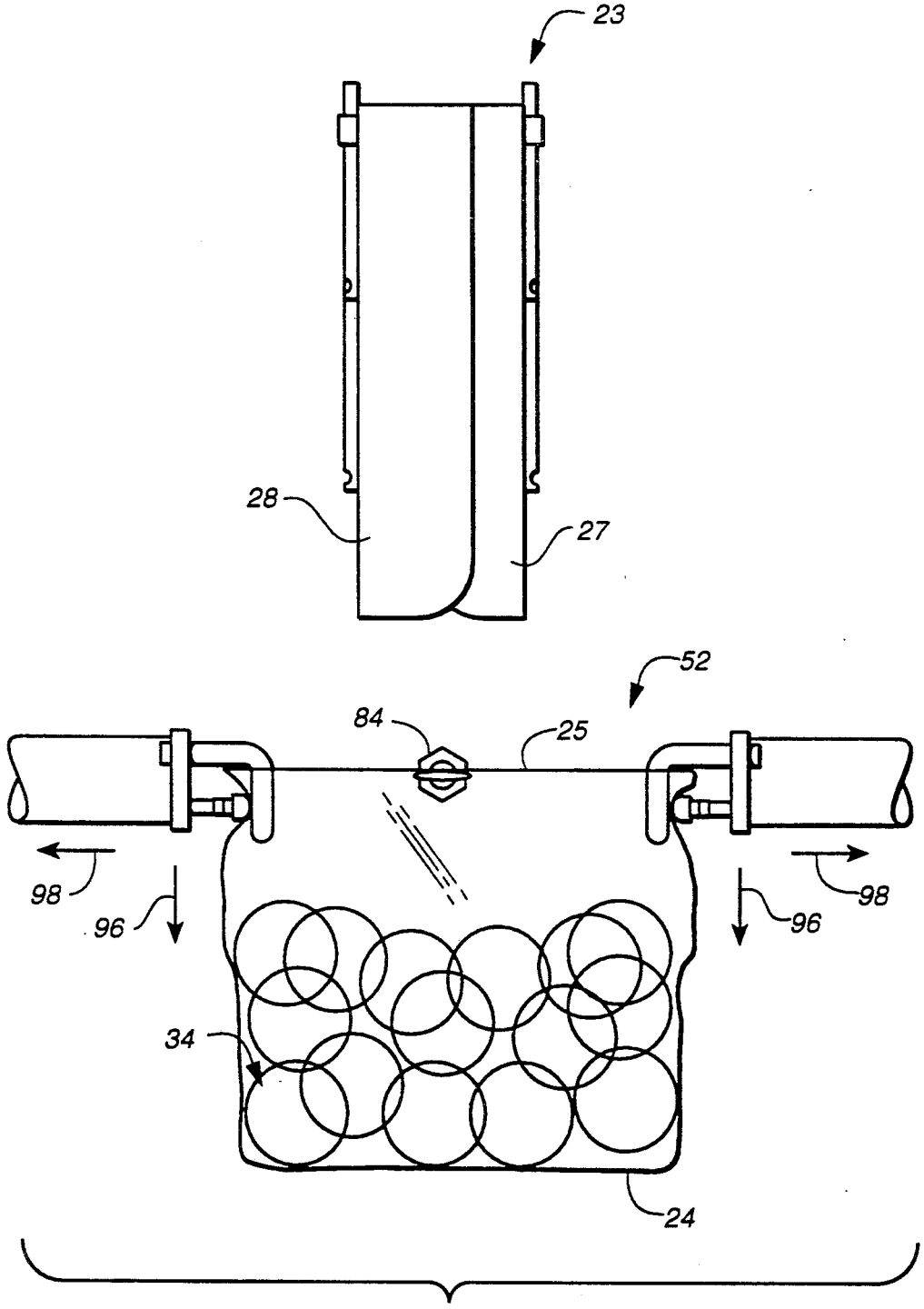

Now that bag 24 is gripped by the transfer assembly, the bag distending assembly may be contracted and the bag transferred from the bag filling station to a bag closure station. C-shaped snout members are moved toward each other in the direction of arrows 97, removing the tension which once retained bag 24 on the distending assembly. Once the bag is no longer retained by assembly 23, transfer apparatus 52, gripping bag 24, is displaced vertically downward in the direction represented by arrows 96 to the position of FIG. 8C for closure. Slots 90 can be seen to extend to the end of the distending assembly so that hook-shaped fingers 82 may be displaced beyond the snout members. FIG. 8C illustrates snout members 27 and 28 in their fully contracted position while bag 24 is removed from assembly 23.

Once at the bag closure station of FIG. 8C, arms 80 may be displaced away from each other in the direction of arrows 98. This movement causes the opposing upper edges 25 of bag 24 to move into close proximity to each other, substantially closing the open end of the bag. Although not limited to this movement, the approach is ideal for subsequent heat sealing by a heat sealing assembly (not shown).

The combination of detecting the proper positioning of bag 24 on distending assembly 23, gripping the bag while still retained on the distending assembly and transferring the bag to a closure apparatus results in very positive location and control of even flexible, heat-sealed plastic bags which greatly improves the reliability of bag filling and closing processes.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably with out departing from the basic principles of the invention.

What is claimed is:

1. In a bag filling apparatus including a bag distending assembly formed to hold an open bag end distended in an open condition at a bag filing station to receive a product to be bagged, and a bag transfer assembly formed to transfer said bag from said bag filling station to a bag closure station for closure of said open bag end, the improvement in said bag filling apparatus comprising:

said bag distending assembly includes an expandable and contractible snout-like assembly holding said bag end in said open condition with two circumferentially extending portions of an edge of said bag defining said bag and exposed for gripping while said bag end is distended;

said bag transfer assembly includes two bag gripping assemblies mounted for movement from a position permitting mounting of said bag on said bag distending assembly at said bag filling station to a position enabling gripping of said bag at said portions of said edge while said bag end is distended by said bag distending assembly, and gripper actuating means coupled to said gripper assemblies and producing gripping of said portions of said edge;

said bag distending assembly further being formed with two slots therein dimensioned to receive said bag gripping assemblies and positioned for extension of said portions of said edges across said slots for gripping, and said bag distending assembly being movable to a release position while said bag is gripped by said gripping assemblies at said bag filling station;

said gripping assemblies further being mounted for movement while gripping said bag from said bag filling station to said bag closure station to remove said bag from said bag distending assembly; and pneumatic bag sensing means mounted on an exterior surface of said snout-like assembly and including at least one conduit having a discharge opening therein facing outwardly of said snout-like assembly, a source of gas under pressure fluid coupled to said conduit, and a pressure sensor fluid coupled to said conduit and sensing an increase in the resistance to the discharge of gas from said discharge opening upon positioning of said bag end over said discharge opening.

2. The bag filling apparatus as defined in claim 1 wherein, said gripping assemblies are movable from a position spaced laterally outwardly of said snout-like assembly to a position in said slots with said gripping assemblies in an open condition to receive said portions of said edges;

said gripping assemblies are further mounted for movement along said slots until said gripping assemblies are positioned to grip said portions of said edge; and sensor means carried by said bag transfer assembly and movable with said gripping assemblies along said slots, said sensor means sensing the position of said edge along said slots.

3. In a bag filling apparatus having a bag distending assembly formed to distend an open end of a bag and hold said bag in a distended condition for filling, the improvement in said bag filling apparatus comprising:

a pneumatic bag detection means mounted on said distending assembly, said pneumatic bag detection means including conduit means having at least one opening for the passage of a gas through said opening, said conduit means being mounted on said distending assembly with said opening positioned sufficiently close to said bag to significantly change the resistance to passage of said gas through said opening when said bag is properly positioned on said distending assembly for filling, and said pneumatic bag detection means further including pressure sensing means fluid coupled to said conduit means and sensing a change in resistance to discharge of said gas form said opening;

said bag distending assembly including an expandable snout assembly formed to be inserted inside an open end of said bag; and said conduit means being mounted on an outwardly facing surface of said snout assembly with said opening facing away form said snout assembly to discharge gas against an inner surface of said bag.

4. The bag filling apparatus as defined in claim 3 wherein, said conduit means includes a plurality of conduits each having a discharge opening therein.

5. The bag filling apparatus as defined in claim 4 wherein, said plurality of conduits includes a first pair of laterally spaced apart conduits on one side of said snout assembly having discharge openings positioned about a common first transverse plane through said snout assembly, and said plurality of conduits further includes a second pair of laterally spaced apart conduits on a substantially opposed side of said snout assembly and having discharge openings positioned at about said first transverse plane.

6. The bag filling apparatus as defined in claim 5 wherein, said plurality of conduits includes a third pair of laterally spaced apart conduits positioned on said one side of said snout assembly having discharge openings positioned at a common second transverse plane axially spaced from said first transverse plane, and said plurality of conduits includes a fourth pair of laterally spaced apart conduits positioned on said opposite side of said snout assembly and having discharge openings positioned at about said second transverse plane.

7. The bag filling apparatus as defined in claim 3 wherein, said pneumatic bag detection means includes a source of gas under pressure fluid coupled to said conduit means, valve means adjusting the amount of said gas discharged from said opening; and said sensing means includes a pressure switch means fluid coupled to said conduit means and responsive to an increase in pressure in said conduit means to provide an output signal.

8. The bag filling apparatus as defined in claim 7, and controller means coupled to one of said bag filling apparatus and bag mounting apparatus to receive bag placement signals therefrom as to the placement of said bag on said distending assembly, and coupled to receive output signal from said pressure switch means, said controller means being responsive to a bag placement signal and the absence of a pressure switch means output signal to prevent filling of said bag.

9. The bag filling assembly as defined in claim 3, and a bag transfer assembly mounted proximate said bag distending assembly, said bag transfer assembly including bag gripping assemblies mounted for movement to and gripping of said bag at two locations along an edge of said bag defining said end while distended on said bag distending assembly, and said bag gripping assembly being mounted for movement away from said bag distending assembly while gripping said bag.

* * * * *

UNITED STATES PATENT AND TRADEMARK OFFICE

CERTIFICATE OF CORRECTION

PATENT NO. : 5,142,846

DATED : September 1, 1992

INVENTOR(S) : Daniel Alameda

It is certified that error appears in the above-identified patent and that said Letters Patent is hereby corrected as shown below:

Column 3, line 30, delete "an" and insert ---and---.

Column 4, line 9, after "scoop", delete "o" and insert ---or---.

Column 5, delete lines 12, 13, and 14 as follows:

"FIG. 8 is a front elevation view of the present invention, as viewed in FIG. 4, showing sensing of a seam has burst.".

Column 13, claim 3, line 26, delete "form" and insert ---from---.

Signed and Sealed this

Fifth Day of October, 1993

*Attest:*

*Attesting Officer*

BRUCE LEHMAN

*Commissioner of Patents and Trademarks*